US006109609A

United States Patent [19]

Ekberg

[11] Patent Number: 6,109,609

[45] Date of Patent: Aug. 29, 2000

[54] EDUCATIONAL CARD GAME AND METHOD

[76] Inventor: Roy V. Ekberg, 2111 E. Santa Fe, No. 346, Olathe, Kans. 66062

[21] Appl. No.: 09/404,447

[22] Filed: Sep. 22, 1999

[51] Int. Cl.[7] ..... A63F 3/00

[52] U.S. Cl. ..... 273/236; 273/292; 273/296; 273/287

[58] Field of Search ..... 273/292, 296, 273/282.1, 272, 273, 293, 299, 148 A, 150, 309, 153 R, 156, 157 R

[56] References Cited

U.S. PATENT DOCUMENTS

| | | |
|---|---|---|
| 904,387 | 11/1908 | Welsh . |
| 2,534,550 | 12/1950 | Frechtmann . |
| 2,879,614 | 3/1959 | Baldanza . |
| 2,913,137 | 11/1959 | Alatorre . |
| 3,377,071 | 4/1968 | Treinis . |
| 3,558,136 | 1/1971 | McFarland . |
| 3,662,477 | 5/1972 | Weinstein . |
| 4,192,513 | 3/1980 | Feeley et al. . |
| 4,258,920 | 3/1981 | Waldron et al. . |
| 4,669,734 | 6/1987 | Watkins . |
| 4,838,551 | 6/1989 | Volpert . |
| 5,439,221 | 8/1995 | Harvie . |
| 5,772,212 | 6/1998 | Hagedorn . |
| 5,887,873 | 3/1999 | Freeman . |
| 5,895,049 | 4/1999 | Fingers . |

OTHER PUBLICATIONS

"King magnetic card game" on page 28 of "The Best playing cards catalog No. 29" from "U.S. Games Systems, Inc., 179 Ludlow street, Stamford, CT 06902, USA" Copyright 1992.

*Primary Examiner*—Sebastiano Passaniti
*Assistant Examiner*—Vishu Mendiratta
*Attorney, Agent, or Firm*—Dale J. Ream

[57] ABSTRACT

An educational card game and method for play comprises a plurality of cards with each card having a surface with indicia imprinted thereon. Each card further includes a raised flange extending across an end of the card. The card game further includes a game board having a channel formed therein for releasably retaining each raised flange such that the cards may be selectably positioned on the game board to display a desired sequence of the indicia. A magnetic strip extends through the channel and selectably cooperates with a metallic element on each raised flange to enhance the adherence of each card to the game board. Points may be awarded as game players successively position cards on the game board.

14 Claims, 5 Drawing Sheets

EDUCATIONAL CARD GAME AND METHOD

BACKGROUND OF THE INVENTION

This invention relates generally to a learning game and, more particularly, to a board game in which cards bearing alphabetic, numeric, or other indicia are releasably positioned on the game board according to a method for learning through association.

A child can learn the alphabet, numbers, colors, and other elements of sets by associating the elements with previously learned elements or simply by matching an element with an identical element. The limited attention span of a small child, however, often provides a hurdle to learning in this manner. It is recognized that some form of entertainment coupled with an educational process is highly beneficial to the learning process. Hence, the term "edutainment" may be appropriately applied to this scenario.

Various card games have been proposed as learning aids. However, known card games for teaching the alphabet or numerals through association either require a user to hold several cards at once (often irregularly shaped cards) or to place them on a flat surface where their placement can be inadvertently disrupted. Such games, therefore, do not provide a convenient means for selectively placing cards on a game board that securely holds the cards during game play yet allows convenient removal or repositioning as desired.

Therefore, it is desirable to have a game in which cards can be held securely to a game board during game play, whether the board is oriented horizontally, vertically, or at some angle therebetween. Further, it is desirable to have a game in which either side of each card may be displayed while being retained on the game board. Also, a game is desired which includes a set of cards having alphabetic, numeric, color, or other indicia on one or both sides of each card.

SUMMARY OF THE INVENTION

Accordingly, the educational game and method for playing according to the present invention includes a plurality of cards having indicia imprinted on a side thereof and having a raised flange extending across a top edge. The game further includes a game board having a channel formed therein for releasably retaining each raised flange therein. The channel includes a magnetic strip and the retaining flange includes a metallic element which detachably adheres to the magnetic strip. Thus, the raised flange of a card mates with the channel for positioning a card on the game board and is held securely thereon by the magnetic attraction between the magnetic strip and metallic element.

The indicia imprinted on the cards and game board may be letters of the alphabet, numerals, or portions of a pictorial scene. Multiple sets of differently colored cards having the same type of indicia may be combined into a single deck of cards for game play with a particular color of cards being "playable." Points are awarded as players properly position cards on the game board. Recognition, matching, and association of the various types of indicia provide an entertaining and effective form of education.

Therefore, a general object of this invention is to provide a game which aids learning through association of elements within a category or set.

Another object of this invention is to provide a game, as aforesaid, having at least one deck of cards individually imprinted with alphabetic, numeric, color, or similar indicia.

Still another object of this invention is to provide a game, as aforesaid, in which individual cards may be selectively positioned and retained on a game board during game play.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
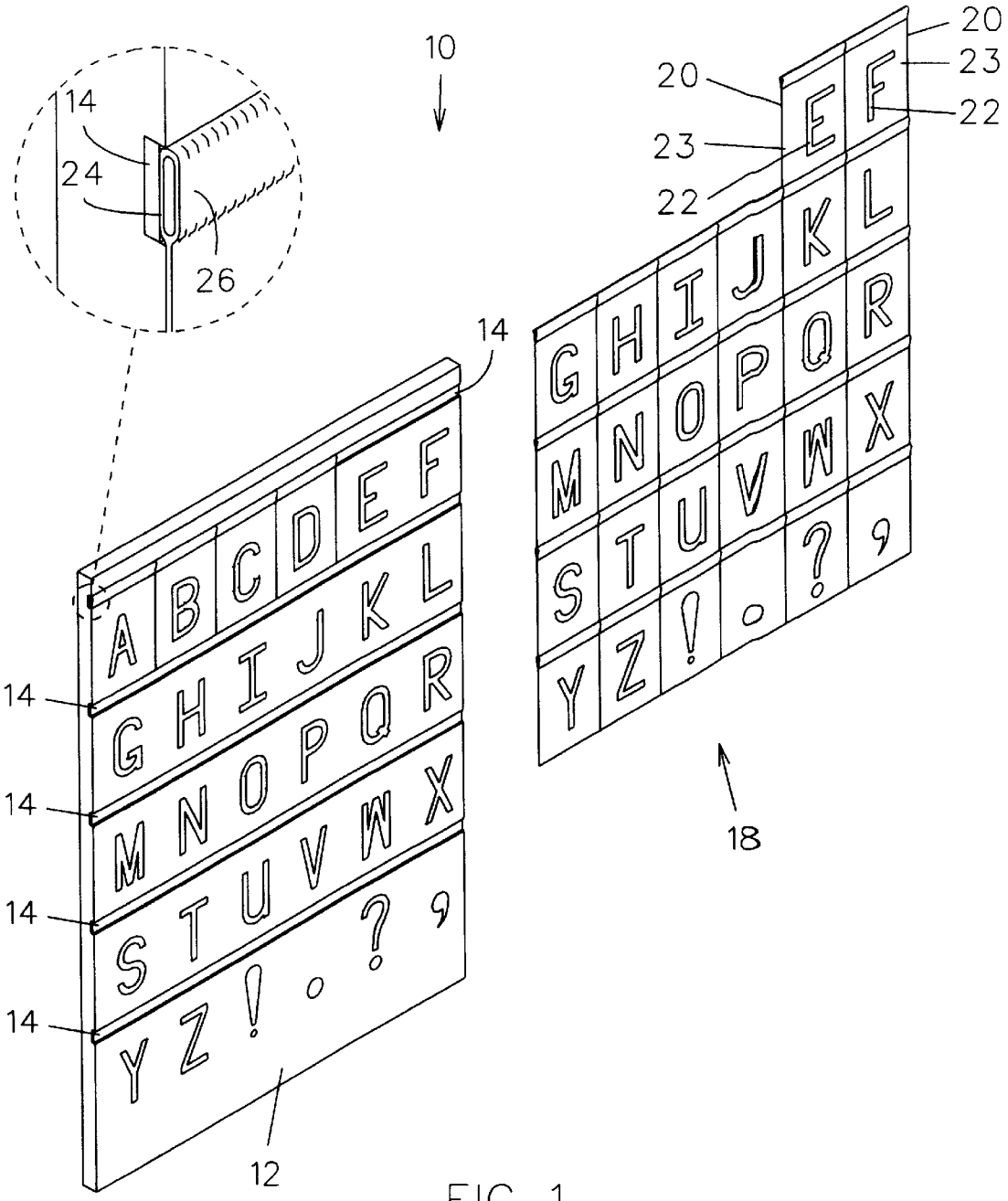
FIG. 1 is a front perspective view of a game board with a set of cards retained thereon such that respective first sides of the cards are visible.
Figure 2:
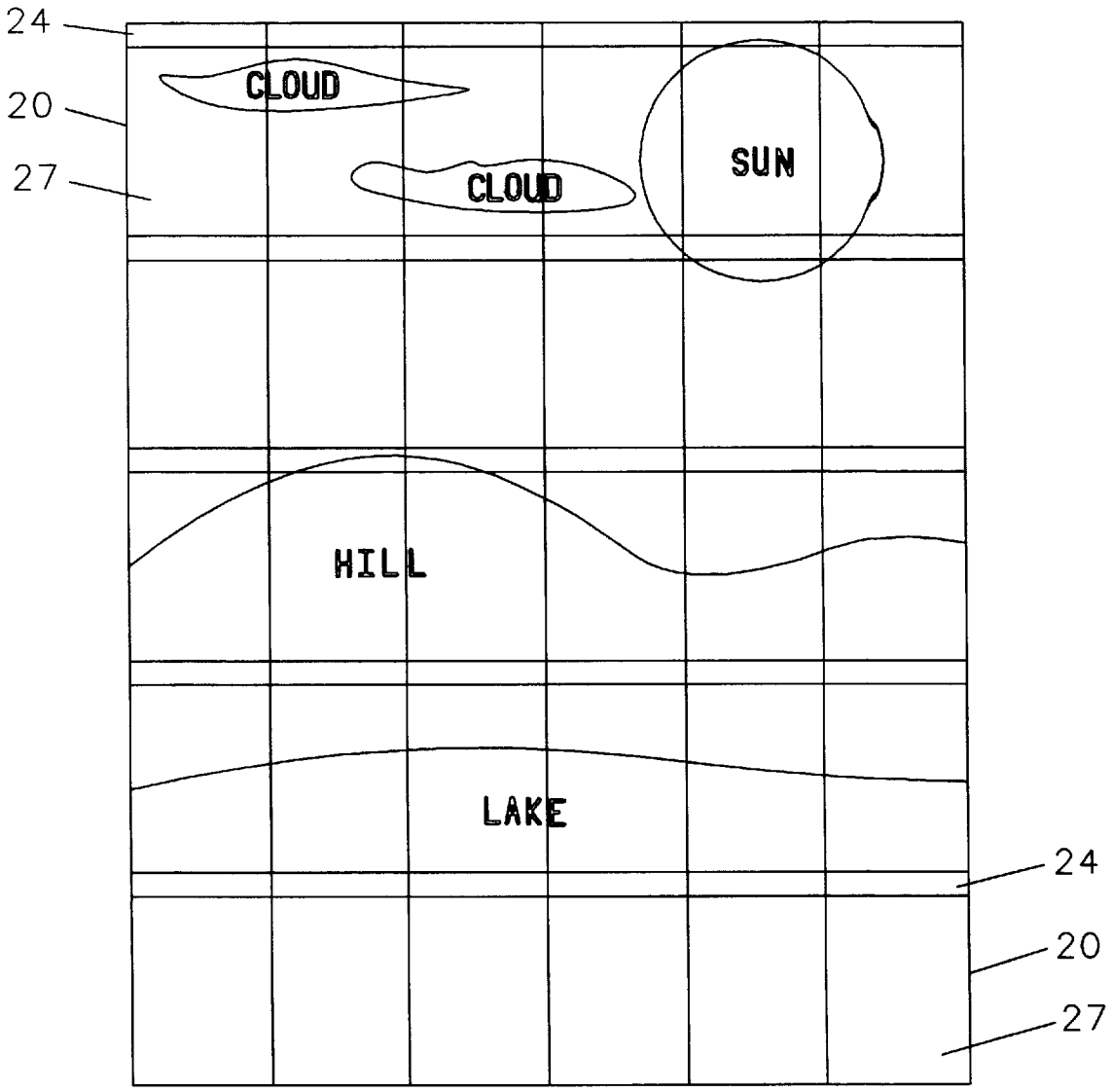
FIG. 2 is a front view of the game board as in FIG. 1 with the cards configured such that respective second sides of the cards are visible.

Turning now more particularly to the drawings, FIGS. 1 and 2 show a preferred embodiment of an educational card game 10 according to the present invention. The card game 10 includes a game board 12 having a generally flat support surface constructed of cardboard although plastic, metal, or fibrous materials would also be suitable. The game board 12 can be held by a user or placed flat against a horizontal or vertical surface. A series of spaced apart elongate channels 14 from a retention structure and extend laterally across the game board 12 and are parallel to one another (FIG. 1). It is understood that the channels 14 can alternatively extend vertically or diagonally across the game board 12 to accommodate various other card games. A magnetic strip extends across the game board within each channel 14.

The game board 12 further includes a series of indicia 16 imprinted along the channels 14. While letters of the alphabet are imprinted on the game board 12 according to the preferred embodiment of the game, other types of indicia could alternatively be utilized, such as numerals or pictures. Also, the back side of the game board 12 may have a construction substantially similar to that of the front side (not shown) and include indicia different than the indicia on the front side such that two different card games may be played using a single game board. The indicia 16 are imprinted in traditional logical sequence, such as alphabetical or numerical order or as necessary to form a picture, as appropriate.

The card game 10 further includes at least one set of cards 18 for use in game play. If multiple sets of cards are provided, each set is formed of card stock of a different color. Multiple sets of cards may be combined into a single deck of cards for game play, as to be more fully described below. Each set of cards 18 includes a plurality of individual cards 20 having a set of indicia 22 represented individually on respective first sides 23 thereof. For example, the set of cards 18 may include a plurality of cards with each card having a different letter of the alphabet imprinted thereon (FIG. 1).

Each card 20 includes a first raised flange 24 extending across a top edge thereof. The first raised flange 24 presents a configuration complementary to the configuration of each channel 14 so as to removably mate therewith. The first raised flange 24 is constructed of a metal that magnetically adheres to the magnetic strip within each channel 14. Alternatively, a magnetic material may be included in the railed flange 24 and a metallic strip within each channel 14. As shown in FIG. 1, each card 20 having a letter of the alphabet imprinted thereon is positioned over a corresponding letter of the alphabet imprinted on the game board 12. Each card 20 further includes a second raised flange 26 extending across the top edge thereof opposite the first raised flange 24. The second raised flange 26 is configured to mate with the channels 14 as previously described. Each card 20 also includes indicia individually represented on respective second sides 27, the indicia being portions of a pictorial scene. When all of the cards 20 are correctly positioned according to the corresponding indicia on the game board 12 and first sides 23 of the cards, a complete pictorial scene is displayed by flipping each card over to reveal the respective second sides 27 (FIG. 2).

Figure 3:
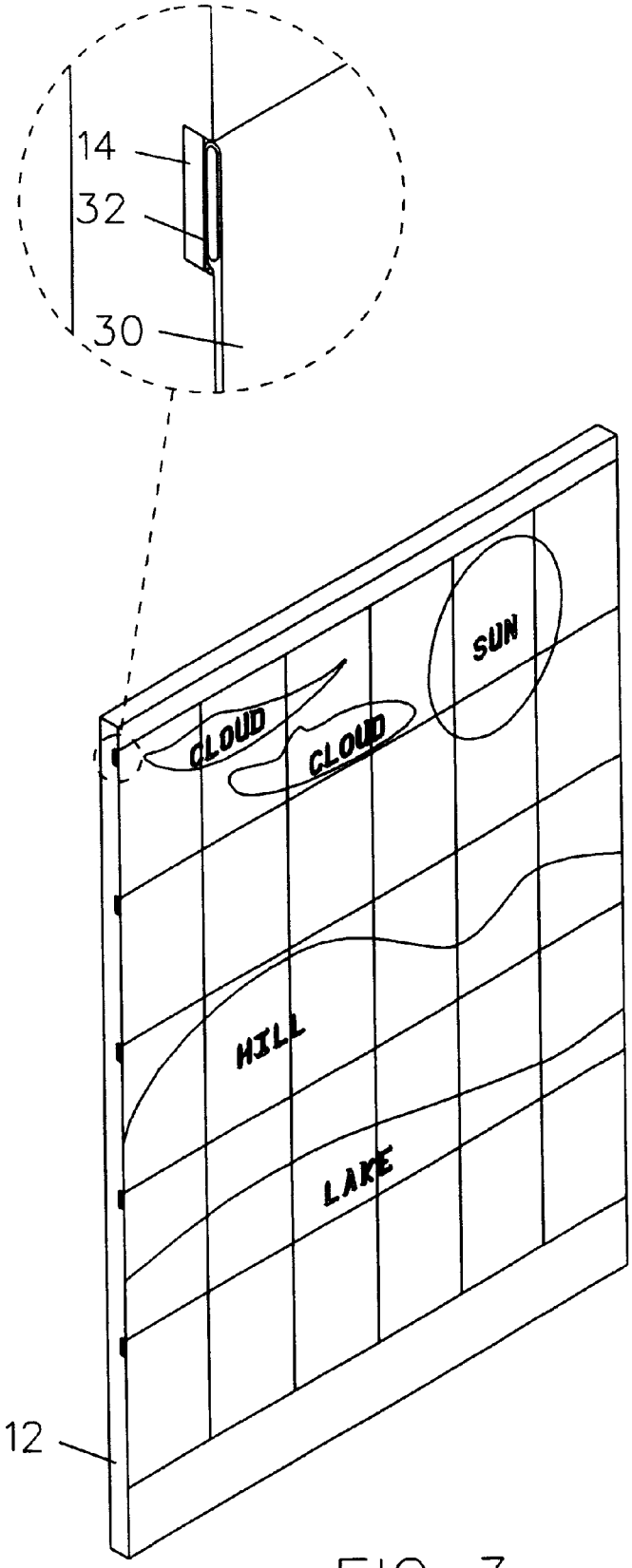
FIG. 3 is a front view of a game board with a set of cards retained thereon according to an alternative embodiment of the invention.

An alternative embodiment of the game 28 is shown in FIG. 3 in which each card 30 in a set of cards includes only a single raised flange 32 configured to mate with the channels 14 of the game board 12. Each card 30 includes indicia imprinted on one side thereof. This embodiment is particularly advantageous for positioning cards which reveal a pictorial scene in that a second raised flange does not interrupt the continuity of the scene.

Figure 4:
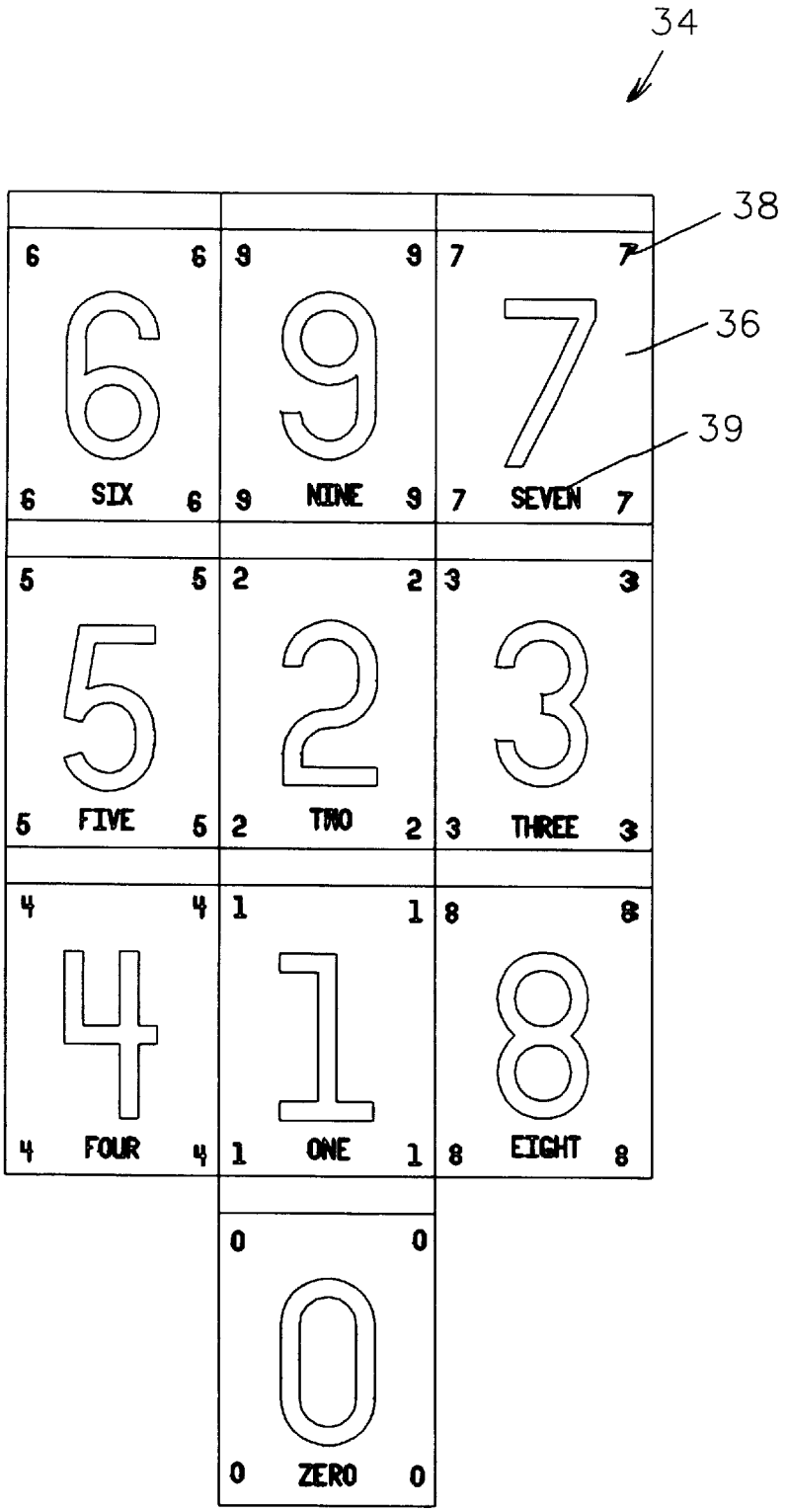
FIG. 4 is front side of a set of cards having numeric indicia on one side thereof.

Referring now to FIG. 4, numeric indicia may be individually represented on cards 36 of another card set 34. The numeric indicia may be imprinted in both number form 38 and word form 39 so as to enhance learning by association. The cards 36 of the numeric card set 34 include raised flanges configured to adhere to the game board as previously described and can be positioned randomly or in logical sequence as desired by a game player. It is understood that pictorial indicia can also be included on the reverse sides of the cards 36 so as to verify correct positioning.

Figure 5:
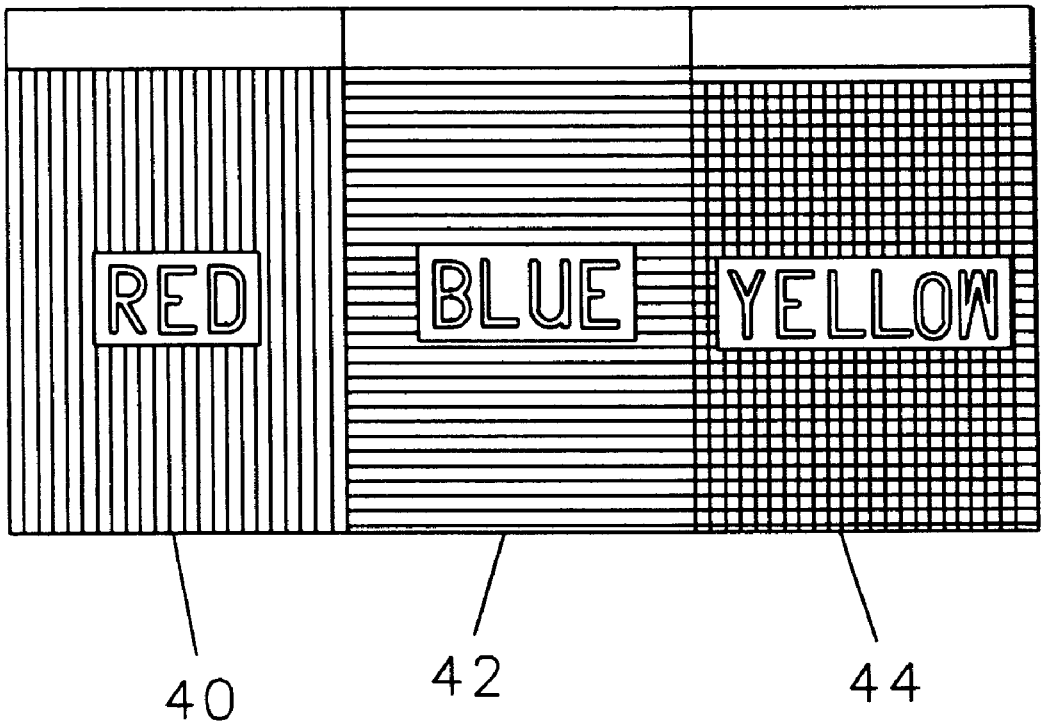
FIG. 5 is a front view of a set of cards having color indicia thereon.

The card game includes multiple card sets 40, 42, 44 having the same type of indicia imprinted thereon. The sets, however, are each characterized by a different color as shown in FIG. 5. For example, differently colored sets of cards having alphabetic indicia imprinted thereon may be combined into a single deck of cards during game play as described below.

In use, a selected number of differently colored card sets having a common type of indicia thereon are combined into a single deck of cards and shuffled (e.g. each set includes alphabetic characters). A predetermined number of cards is then dealt to each of a desired number of game players. Cards having a particular color may be designated as "playable". In succession, each user is given opportunity to position one or more cards on the game board with points being scored as agreed upon by the players. If a player does not have a "playable" card, the player must draw a predetermined number of additional cards from the deck. The player also draws additional cards according to the number of cards played. The next player in succession repeats these steps. According to the preferred embodiment, positioning a card on the game board involves superimposing a card having a particular marking over a corresponding marking on the game board 12 (e.g. matching alphabetic characters). When all playable cards have been positioned, the winner is declared to be the player who accumulated the most points. It is understood that this game can be played by a single player, such as by a child who is learning the correct logical sequence of the alphabet or numbers. When all of the cards have been positioned, the cards may be flipped over to reveal a pictorial scene which verifies the accuracy of original card placements.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A board game, comprising:

a plurality of tiles, each said tile having a first surface and a raised flange extending across an end thereof;

a first set of indicia represented individually upon respective surfaces of said tiles; a support surface having a channel formed therein for releasably retaining each said raised flange therein;

a second set of indicia imprinted along said channel on said game board, said first and second sets having matching indicia, whereby each said tile may be positioned over a corresponding indicia on said support surface; and wherein each said tile includes a second surface with indicia imprinted thereon and a second raised flange extending across said end of said tile opposite said first raised flange, whereby each said tile may be moved from a position in which said first surface is visible to a position in which said second surface is visible so as to display said indicia on respective second surfaces.

2. A board game as in claim 1 wherein one of said channel and said raised flange includes a magnetic strip extending transversely there-across; and the other of said channel and said raised flange includes a metallic element for detachably adhering to said magnetic strip.

3. A board game as in claim 1 wherein one of said channel and said raised flange includes a magnetic strip extending transversely there-across; and the other of said channel and said second raised flange includes a metallic element for detachably adhering to said magnetic strip.

4. A game board as in claim 1 wherein said plurality of tiles comprises a deck of cards.

5. A game board as in claim 1 wherein said indicia comprises alphanumeric characters, said indicia on each said tile being different than any other said indicia.

6. A game board as in claim 1 wherein said indicia comprises pictorial markings, said indicia on each said tile being different than any other said indicia.

7. A method of playing a card game for learning the elements of a given set, comprising the steps of:

providing a game board having a retention structure extending transversely thereon and a set of distinctive markings imprinted in logical sequence on said game board adjacent said retention structure;

providing a second set of distinctive markings upon respective first sides of each card in a set of cards, each said card having a flange adapted to mate with said retention structure when said first side is facing away from said game board such that said cards may be selectively positioned on said game board to display said second set of distinctive markings in logical sequence, said set of cards including:

a portion of a scene imprinted on respective second sides of each said card;

a second flange on each said card adapted to mate with said retention structure when said second side is facing away from said game board;

selecting a single card from said set of cards;

positioning said selected card on said game board such that the distinctive marking on said selected card is superimposed over a corresponding marking imprinted on said game board and the flange of said selected card is retained by said retention structure;

repeating the steps of selecting and positioning until all of said cards have been positioned on said game board; and moving each said card from a position in which said first side is visible to a position in which said second side is visible so as to display said scene.

8. A method as in claim 7 wherein said retention structure is an elongate channel.

9. A method as in claim 7 wherein said retention structure is a magnetic strip; and said flange includes a metallic element for detachably adhering to said magnetic strip such that each said card may be selectively positioned on said game board.

10. A method as in claim 7 further comprising the steps of:

providing a deck of cards having a plurality of sets of cards, each set of cards including a predetermined number of identically colored cards;

dealing a predetermined number of cards from said deck of cards to each of a predetermined number of game players; and positioning one said card on said game board successively by each said game player so as to display said second set of distinctive markings.

11. A method as in claim 10 further comprising the steps of:

selecting a color of cards eligible to be played from said deck of cards; and choosing an additional card from said deck of cards when a previously dealt card is positioned on said game board.

12. A method as in claim 7 further comprising the steps of:

awarding a predetermined number of points to a game player for correctly positioning each said card upon said game board; and declaring a game player to be the winner who has accumulated the most points when all cards eligible for game play have been positioned.

13. A method as in claim 7 wherein said distinctive markings on said game board are alphabetic characters; and said distinctive markings on said respective first sides of each card are alphabetic characters.

14. A method as in claim 7 wherein said distinctive markings on said game board are numeric characters; and said distinctive markings on said respective first sides of each card are numeric characters.

* * * * *